US006338632B1

(12) United States Patent
Jones

(10) Patent No.: US 6,338,632 B1
(45) Date of Patent: Jan. 15, 2002

(54) COMPLIANT, PRESS FIT ELECTRICAL CONTACT HAVING IMPROVED RETENTION

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/610,671

(22) Filed: Jul. 5, 2000

(51) Int. Cl.[7] ..... H01R 13/41
(52) U.S. Cl. ..... 439/82
(58) Field of Search ..... 439/825–827, 439/82, 751

(56) References Cited

U.S. PATENT DOCUMENTS 3,031,641 A * 4/1962 Camzi ..... 439/825
4,775,326 A * 10/1988 Lenaerts et al. ..... 439/82
4,909,746 A * 3/1990 Scholz ..... 439/82
5,230,642 A * 7/1993 Schempp ..... 439/82
5,653,601 A * 8/1997 Martucci et al. ..... 439/82
5,695,357 A * 12/1997 Wright ..... 439/825

* cited by examiner

*Primary Examiner*—Gary F. Paumen
*Assistant Examiner*—James Harvey
(74) *Attorney, Agent, or Firm*—WeiTe Chung

(57) ABSTRACT

A compliant press fit contact 1 comprises a retaining mounting portion 12 in the shape of a hollow cylinder for mounting the press fit contact into a metal-coated hole 22 defined in a printed circuit board 2. The mounting portion defines a plurality of slots 121 and a slit 122, which are spaced apart from each other, dividing the mounting portion into a plurality of spring beams 120. Each beam has an arced outer surface for engaging with a wall 220 of the metal-coated hole. When inserted into the hole, the mounting portion deforms toward a center thereof, thereby securely retaining the press fit contact 1 in the hole.

1 Claim, 4 Drawing Sheets

COMPLIANT, PRESS FIT ELECTRICAL CONTACT HAVING IMPROVED RETENTION

FIELD OF THE INVENTION

The present invention relates to an electrical contact, and particularly to a compliant, press fit electrical contact having improved retention means.

BACKGROUND OF THE INVENTION

Referring to FIG. 7, an U.S. Pat. No. 4,775,326 discloses a press fit contact comprising a mounting portion (not labeled) for mounting the press fit contact in a hole 8 defined in a printed circuit board (not shown). The wall of such a hole is normally lined with copper or the like, which is electrically connected with one or more electrical circuits of the printed circuit board. The mounting portion comprises a pair of outer legs 3, 5 and a center leg 4 between the outer legs 3, 5 which deform and press against the wall of the hole 8 when the legs 3, 4, 5 are inserted into the hole 8. The contact is retained in the hole 8 by friction between the legs 3, 4, 5 and the hole 8. However, the legs 3, 4, 5 contact the wall of the hole 8 at a limited number of points, designated as 11 and 7, which together have a limited contact area. A correspondingly large sheer stress exists at each interface between the legs 3, 4, 5 and the wall of the hole 8. Thus, the press fit contact 1 may damage the copper lining of the hole 8 during insertion, thereby reducing the electrical conduction therebetween. Furthermore, the total area of engagement of the mounting portion and the wall of the hole 8 is so small that the friction force therebetween is unreliable for retaining the contact in the hole. Therefore, over a period of usage and a number of thermal cycles, the press fit contact will yield, shift in the hole 8 and lose electrical performance, thereby affecting reliability of signal transmission.

Hence, an improved press fit contact is required to overcome the disadvantages of the prior art.

BRIEF SUMMARY OF THE INVENTION

A first object of the present invention is to provide a compliant press fit contact which can be securely retained in a hole of a PCB;

A second object of the present invention is to provide a compliant press fit contact which will not damage a plated pad in a hole of a PCB during insertion into the hole.

A compliant press fit contact in accordance with the present invention comprises a retaining mounting portion for mounting the press fit contact into a metal-coated hole defined in a printed circuit board. The mounting portion is in the shape of a hollow cylinder and defines three slots extending a partial length of the mounting portion and a slit extending a full length of the mounting portion. The slots and the slit are spaced apart from each other in such fashion as to divide the mounting portion into four spring beams. Each beam has an arcuate outer surface bearing against the wall of the metal-coated hole, which elastically deforms, thereby frictionally retaining the press fit contact in the hole.

Other objects, advantages and novel features of the invention will become more apparent from the following detailed description of the present embodiment when taken in conjunction with the accompanying drawings.

DETAILED DESCRIPTION OF THE INVENTION

Figure 1:
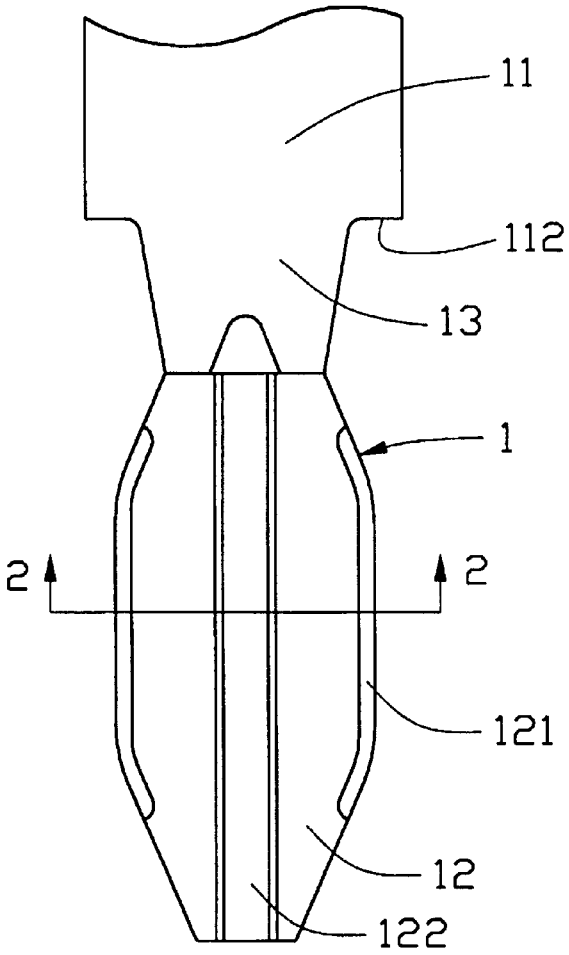
FIG. 1 is a planar front view of a press fit contact of the present invention.
Figure 3:
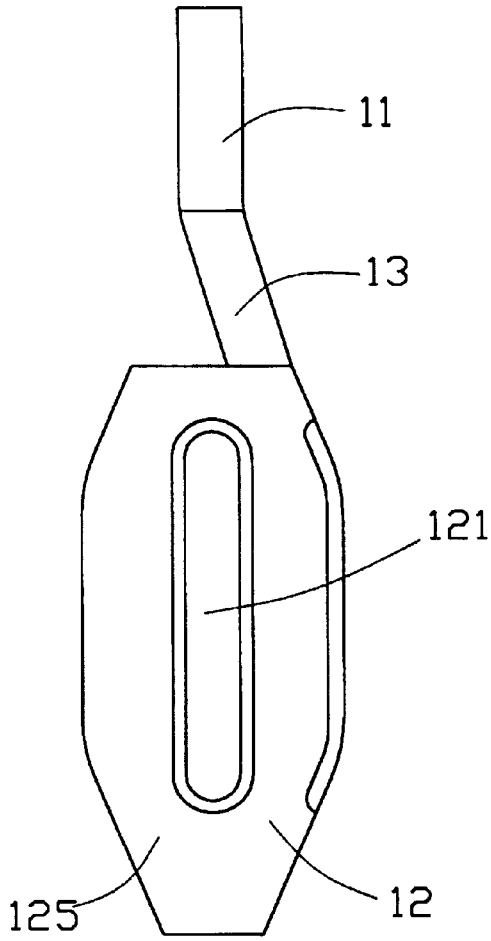
FIG. 3 is a planar side view of FIG. 1.
Figure 2:
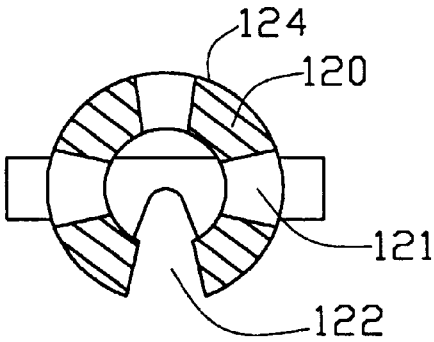
FIG. 2 a cross-sectional view taken along line 2—2 of FIG. 1.
Figure 4:
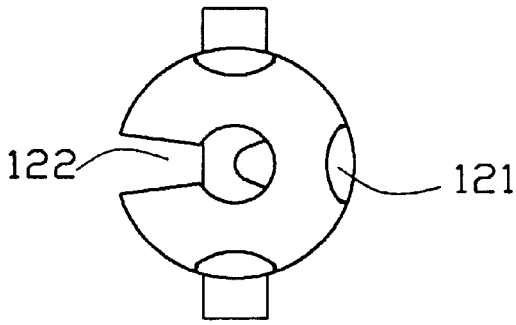
FIG. 4 is a bottom view of FIG. 3.
Figure 5:
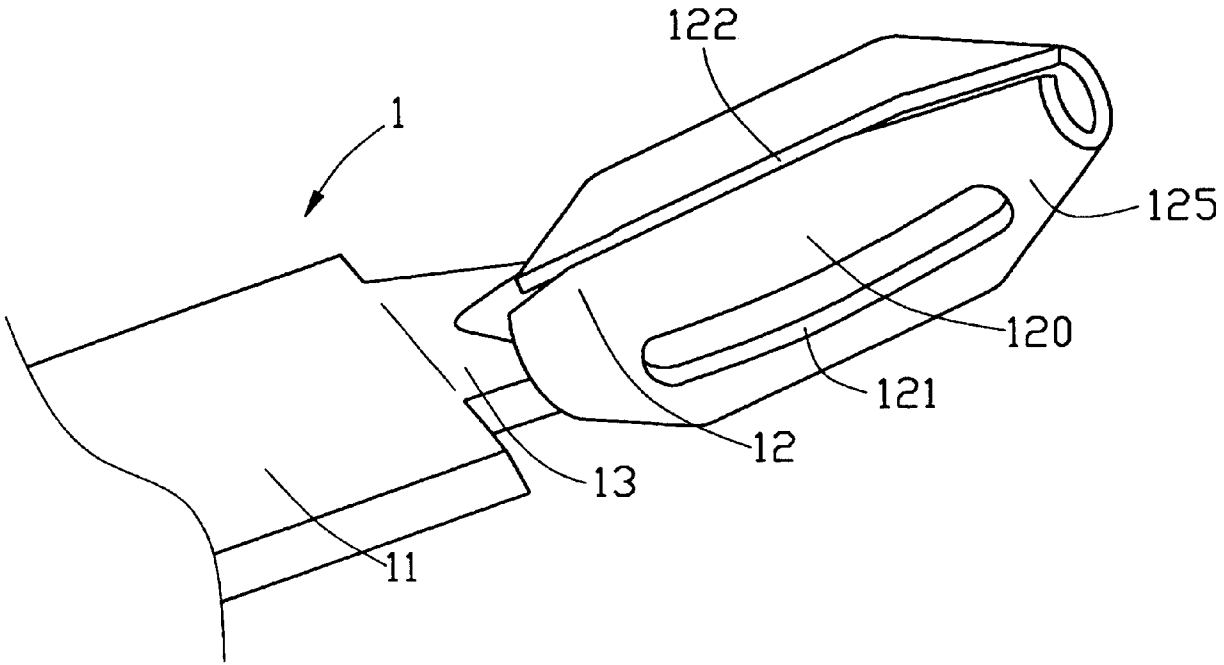
FIG. 5 is a perspective view of the press fit contact of FIG. 1.

Referring to FIGS. 1 through 6, a compliant press fit contact 1 in accordance with the present invention comprises a head portion 11, a retaining mounting portion 12 and a link portion 13 between the head portion 11 and the mounting portion 12. The head portion 11 mechanically and electrically connects to an electrical device (not shown) which is to be connected to a printed circuit board (PCB) 2. The press fit contact 1 mounts into a hole 22 defined in the PCB 2. The hole 22 has a nominal diameter that is less than a maximum outer diameter of the mounting portion 12. As will be explained below, the mounting portion 12 comprises a spring system which, upon insertion into the hole 22, produces a retaining force acting on a copper-coated wall 220 of the hole 22 to retain the contact 1 in the PCB 2 and to establish an electrical connection therebetween. The mounting portion 12 is designed in such a manner that, within the tolerance range of the hole diameter, it will generate a sufficient retaining force and still will not damage the coating of the hole upon insertion into the hole. The head portion 11 forms a pair of shoulders 112 for abutting against an edge of the PCB 2 around the hole 22.

Figure 6:
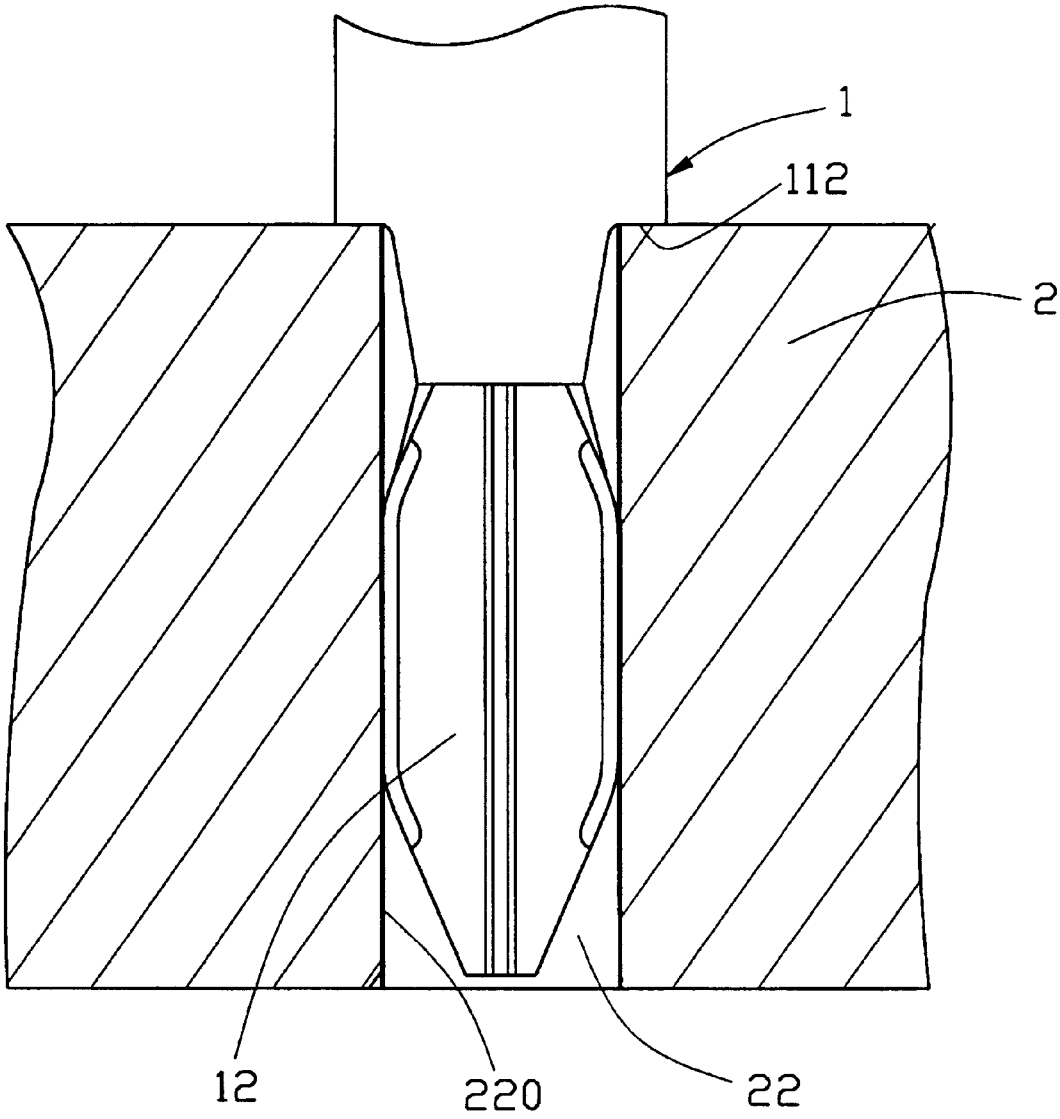
FIG. 6 is the press fit contact of FIG. 1 shown inserted into a hole of a printed circuit board which is taken in cross-section to particularly show the engagement of the contact with the wall of the hole.
Figure 7:
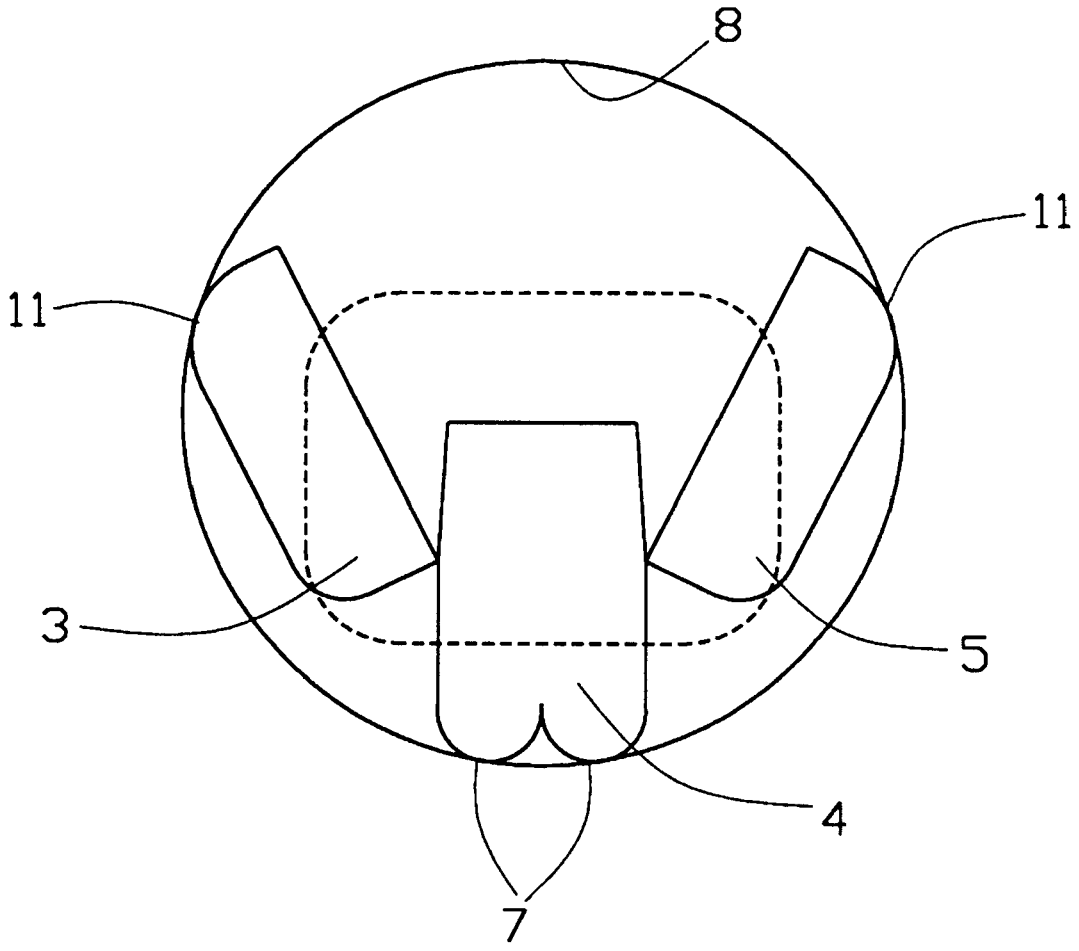
FIG. 7 (PRIOR ART)
FIG. 7 is an end view of a prior art press fit contact inserted in a hole of a printed circuit board.

The mounting portion 12 of the press fit contact 1 is formed in the shape of a hollow cylinder and defines three longitudinal slots 121 extending a partial length of the mounting portion 12 and a slit 122 extending a full length of the mounting portion 12. The slots 121 and the slit 122 are spaced apart from each other and thus divide the mounting portion 12 into four spring beams 120 each having an arc-shaped cross-section. Each spring beam 120 has an arced outer surface 124 for engaging the wall 220 of the hole 22, elastically deforming upon insertion into the hole 22. A lower end 125 of the mounting portion 12 is tapered for facilitating insertion of the press fit contact 1 into the hole 22. Referring to FIG. 6, the four spring beams 120 flex evenly toward a center of the mounting portion 12 to an amount determined by the actual diameter of the hole 22 and the mounting portion 12. By virtue of their resilient qualities, the spring beams 120 exert a force against the wall 220 of the hole 22. Thus, the press fit contact 1 is securely retained in the hole 22 by the outer surfaces 124 of the four spring beams 120 elastically deforming to engage with the wall 220 of the hole 22.

The mounting portion of the press fit contact of the present invention engages with the copper-coated hole by four arced outer surfaces thereof. Thus, the contacting area of the mounting portion and the hole is greater than that of the prior art contact, thereby enhancing the retaining force between the mounting portion and the hole. Furthermore, because of the increased engaging area and the corresponding lower stress force at the mounting portion-hole interface, the insertion/withdrawal of the mounting portion to/from the hole will not damage the copper coating of the hole. Moreover, the mounting portion elastically deforms when engaged in a hole and maintains its spring capability when it is inserted into the hole and after repeated thermal cycles, thereby ensuring the press fit contact in accordance with the present invention maintains a reliable electrical connection with the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A compliant press fit contact for mounting an electrical device to a printed circuit board to establish an electrical connection therebetween, the printed circuit board having a metal coated hole, said press fit contact comprising an elongate mounting portion defining three of slots extending longitudinally along a partial length of the mounting portion and a slit extending longitudinally along a full length of the mounting portion, said slots and slit being spaced apart from each other to divide the mounting portion into four of spring beams, each beam having an outwardly arced outer surface adapted for elastically engaging with a wall of the metal coated hole;

wherein the mounting portion is in the shaped of a hollow cylinder stamped from sheet metal;

wherein a lower end of the mounting portion is tapered for facilitating insertion of the mounting portion into the hole;

further comprising a substantially flat head portion above the mounting portion;

wherein the head portion forms a shoulder adapted for abutting against an edge of the printed circuit board around the hole when the mounting portion is pressed into the hole.

* * * * *